US008113369B2

(12) United States Patent
Mast et al.

(10) Patent No.: US 8,113,369 B2
(45) Date of Patent: Feb. 14, 2012

(54) CONTAINER

(75) Inventors: Luke A. Mast, Brooklyn, MI (US); Walter J. Strasser, Cement City, MI (US); David Downing, Ann Arbor, MI (US); Frederick C. Beuerle, Jackson, MI (US)

(73) Assignee: Amcor Limited, Abbotsford, Victoria (AU)

( * ) Notice: Subject to any disclaimer, the term of this patent is extended or adjusted under 35 U.S.C. 154(b) by 502 days.

(21) Appl. No.: 12/341,372

(22) Filed: Dec. 22, 2008

(65) Prior Publication Data

US 2010/0155360 A1 Jun. 24, 2010

(51) Int. Cl.
*B65D 1/02* (2006.01)
*B65D 1/42* (2006.01)

(52) U.S. Cl. ..... 215/381; 215/384; 220/675

(58) Field of Classification Search ..... 215/379–384, 215/900; 220/666, 669, 675, 771
See application file for complete search history.

(56) References Cited

U.S. PATENT DOCUMENTS

| | | | | |
|---|---|---|---|---|
| 5,064,081 | A * | 11/1991 | Hayashi et al. | 215/373 |
| 5,341,946 | A * | 8/1994 | Vailliencourt et al. | 215/381 |
| 6,273,282 | B1 * | 8/2001 | Ogg et al. | 215/381 |
| 6,923,334 | B2 * | 8/2005 | Melrose et al. | 215/381 |
| 6,935,525 | B2 * | 8/2005 | Trude | 215/381 |
| 7,004,342 | B2 * | 2/2006 | Bourque et al. | 215/384 |
| 7,021,479 | B2 * | 4/2006 | Pedmo et al. | 215/381 |
| 2001/0035392 | A1 * | 11/2001 | Ota et al. | 215/381 |
| 2004/0129598 | A1 * | 7/2004 | Zhang et al. | 206/524.8 |
| 2005/0121408 | A1 * | 6/2005 | Deemer et al. | 215/381 |
| 2005/0247664 | A1 * | 11/2005 | Lane et al. | 215/381 |
| 2006/0151425 | A1 | 7/2006 | Kelley et al. | |
| 2006/0175284 | A1 * | 8/2006 | Noll et al. | 215/382 |
| 2007/0045222 | A1 | 3/2007 | Denner et al. | |
| 2009/0321384 | A1 * | 12/2009 | Zhang et al. | 215/383 |

FOREIGN PATENT DOCUMENTS

| | | |
|---|---|---|
| JP | 62-052033 | 3/1987 |
| JP | 07-112856 | 12/1995 |
| WO | WO 96/37416 | 11/1996 |

* cited by examiner

*Primary Examiner* — Sue Weaver
(74) *Attorney, Agent, or Firm* — Harness, Dickey & Pierce, P.L.C.

(57) ABSTRACT

A blow molded container has a neck portion defining a mouth. The neck portion leads into a shoulder portion and a bottom portion forms a container base. A sidewall portion connects the shoulder portion and the bottom portion and employs a first pair of opposing convex vacuum panels and a second pair of opposing convex vacuum panels. The first pair of opposing convex vacuum panels is larger in surface area than the second pair of opposing convex vacuum panels. A vertical column at each corner of the container joins the first pair of opposing vacuum panels to the second pair of opposing vacuum panels. A structural convex arch resides above and below each convex vacuum panel. Each of the vertical columns are molded into the structural convex arches. Vacuum initiator grooves may be molded into the first and second pair of opposing vacuum panels to control vacuum panel movement.

18 Claims, 8 Drawing Sheets

CONTAINER

FIELD

The present disclosure relates to a container that employs vertical columns and vacuum side panels to control container deformation during reductions in product volume that occur during cooling of a hot-filled product.

BACKGROUND

The statements in this section merely provide background information related to the present disclosure and may not constitute prior art. Containers made of plastic, such as polyethylene terephthalate ("PET"), have become commonplace for the packaging of liquid products, such as fruit juices and sports drinks, which must be filled into a container while the liquid is hot to provide for adequate and proper sterilization of the product. Because these plastic containers are normally filled with a hot liquid, the product that occupies the container is commonly referred to as a "hot-fill product," and the container is commonly referred to as a "hot-fill container." During filling of the container, the product is typically dispensed into the container at a temperature of at least 180° F. Immediately after filling, the container is sealed or capped, such as with a threaded cap, and as the product cools to room temperature, a negative internal pressure or vacuum forms within the sealed container. Although PET containers that are hot-filled have been in use for quite some time, such containers are not without their share of limitations.

One limitation of PET containers that receive a hot-filled product is that during cooling of the liquid product, the containers may undergo an amount of physical distortion. More specifically, a vacuum or negative internal pressure caused by a cooling and contracting internal liquid may cause the container body or sidewalls to deform in unacceptable ways to account for the pressure differential between the space inside of the container and the space outside, or atmosphere surrounding, the container. Containers with deformations are aesthetically unpleasing and may lack mechanical properties to ensure sustained container strength or sustained structural integrity while under a negative pressure.

Another limitation of PET containers that receive a hot-filled product is that they are not easily held by a hand of a handler, such as a consumer who is drinking the product directly from the container or pouring the product from the container into a smaller container, such as a drinking glass. For instance, intended container gripping areas typically located on the body of containers are not designed to conform to a user's hand or accept specific parts of a user's hand to maximize holding capacity while also accounting for the above-mentioned pressure differential associated with hot-filled containers.

Another limitation of plastic containers, such as hot-fill containers, is that such containers may be susceptible to buckling during storage or transit. Typically, to facilitate storage and shipping of PET containers, they are packed in a case arrangement and then the cases are stacked case upon case, such as on pallets that are then lifted and moved with fork-lifts. While stacked one upon another, each container is capable of buckling and subject to compression upon itself due to the weight of direct vertical loading. Such loading may result in container deformation or container rupture, both of which are potentially permanent, which may then render the container and internal product as unsellable or unusable.

Yet another limitation with hot-filled containers lies in preserving the body strength of the container during the cooling process. One way to achieve container body strength is to place a multitude of vertical or horizontal ribs in the container to increase the moment of inertia in the body wall in select places. However, such multitude of ribs increases the amount of plastic material that must be used and thus contributes to the overall weight and size of the container.

SUMMARY

The present invention provides a hot-fillable, blow-molded plastic container suitable for receiving a liquid product that is initially delivered into the container at an elevated temperature. The container is subsequently sealed such that liquid product cooling results in a reduced product volume and a reduced pressure within the container. The container is lightweight compared to containers of similar size yet controllably accommodates the vacuum pressure created in the container. Moreover, the container provides excellent structural integrity and resistance to top loadings from filler valves and weight placed on top of the container. The container advantageously accommodates more than one size hand for secure gripping and handling of the container. A vertical column at each of the four corners of the container provides hoop strength, a physical gripping area suited to the human hand, and vertical strength so that the container may resist buckling under top loading.

Possessing a central vertical and a central horizontal axis, as well as a body or sidewall central horizontal axis, the container structure further employs a neck portion defining a mouth, a shoulder portion that is formed with and molded into the neck portion and that extends downward from the neck portion, a bottom portion forming a base, and a body or sidewall that extends between and joins the shoulder portion and the bottom portion. The sidewall further defines four vertical columns, one at each corner of the container to facilitate gripping, provide strength to the sidewall, and concentrate and direct sidewall movement. When filled with a hot liquid that is then cooled, the four columns provide overall container strength to permit the walls between the columns to contract inward to an extent because the container interior experiences and sustains an interior vacuum. Moreover, the body or sidewall defines a pair of opposing vacuum panels that are oriented between the columns. The base and shoulder areas employ arches above each of the vacuum panels to provide strength to the shoulder and base areas. The arches protrude outwardly to approximately the same extent as the columns so that the vacuum panels are recessed to facilitate gripping. Vacuum initiators, also called hinges or grooves, are longitudinally resident in the vacuum panels and are formed as part of each of the pair of opposing vacuum panels.

Further areas of applicability will become apparent from the description provided herein. It should be understood that the description and specific examples are intended for purposes of illustration only and are not intended to limit the scope of the present disclosure.

DRAWINGS

The drawings described herein are to scale and are for illustration purposes only. The drawings are not intended to limit the scope of the present disclosure in any way.

DETAILED DESCRIPTION

Figure 1:
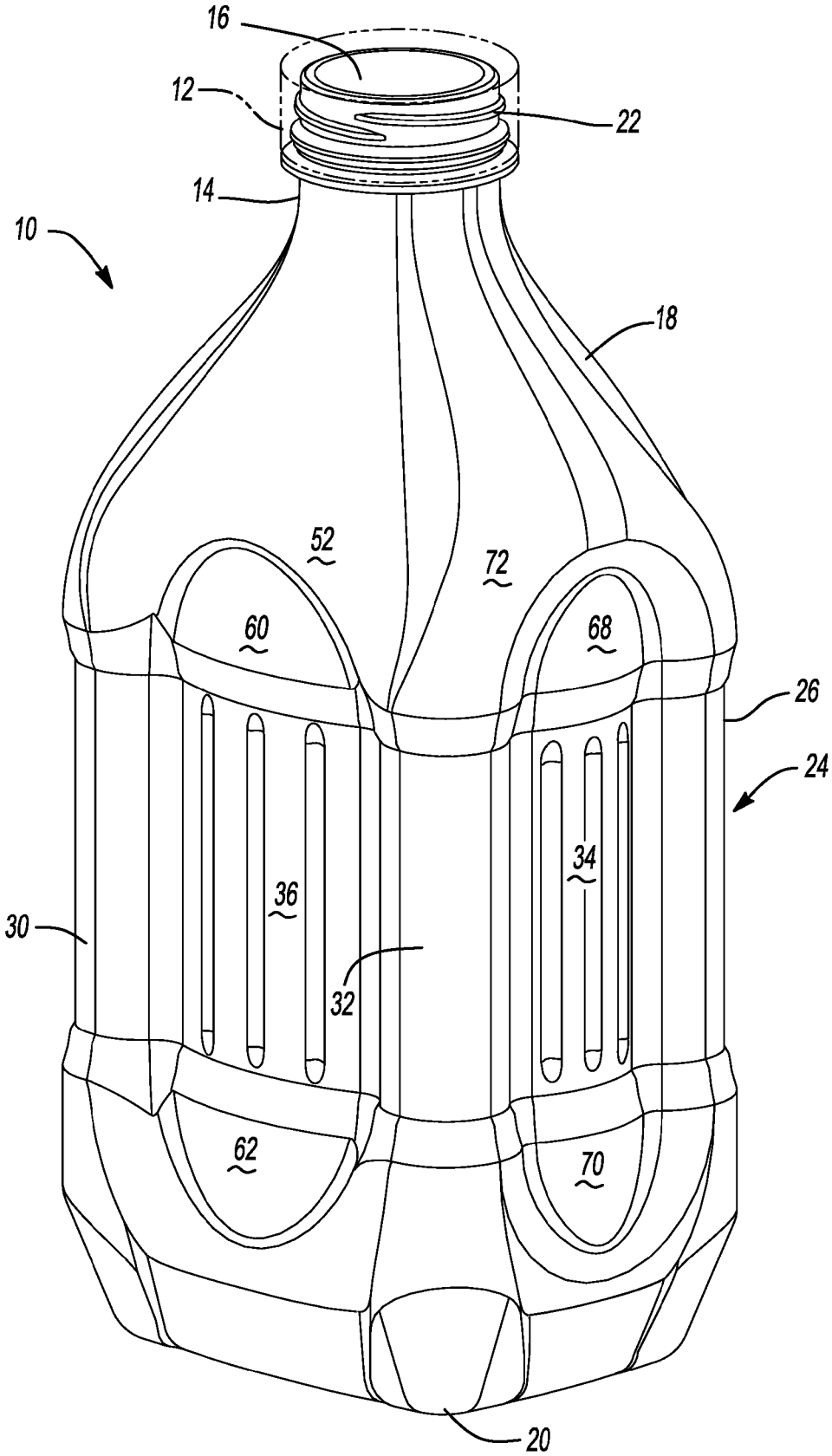
FIG. 1 is an overall perspective view of a container depicting sidewalls with vacuum panels.

The following description is merely exemplary in nature and is not intended to limit the present disclosure, application, or uses. It should be understood that throughout the drawings, corresponding reference numerals indicate like or corresponding parts and features.

Referring now to FIGS. 1-8, and first to FIG. 1, a hot-fill, blow molded plastic container 10 is depicted that exemplifies principles of the present invention. The container 10 is designed to be filled with a product, typically a liquid such as a fruit juice or sports drink, while the product is in a hot state, such as at or above 180 degrees Fahrenheit. After filling, the container 10 is sealed, such as with a cap 12, and then cooled. During cooling, the volume of the product in the container 10 decreases which in turn results in a decreased pressure, or vacuum, within the container 10. While designed for use in hot-fill applications, it is noted that the container 10 is also acceptable for use in non-hot-fill applications.

Since the container 10 is designed for "hot-fill" applications, the container 10 is manufactured out of a plastic material, such as polyethylene terephthalate ("PET"), and is heat set enabling such that the container 10 is able to withstand the entire hot-fill procedure without undergoing uncontrolled or unconstrained distortions. Such distortions may result from either or both of the temperature and pressure during the initial hot-filling operation or the subsequent partial evacuation of the container's interior as a result of cooling of the product. During the hot-fill process, the product may be, for example, heated to a temperature of about 180 degrees Fahrenheit or above and dispensed into the already formed container 10 at these elevated temperatures.

Figure 2:
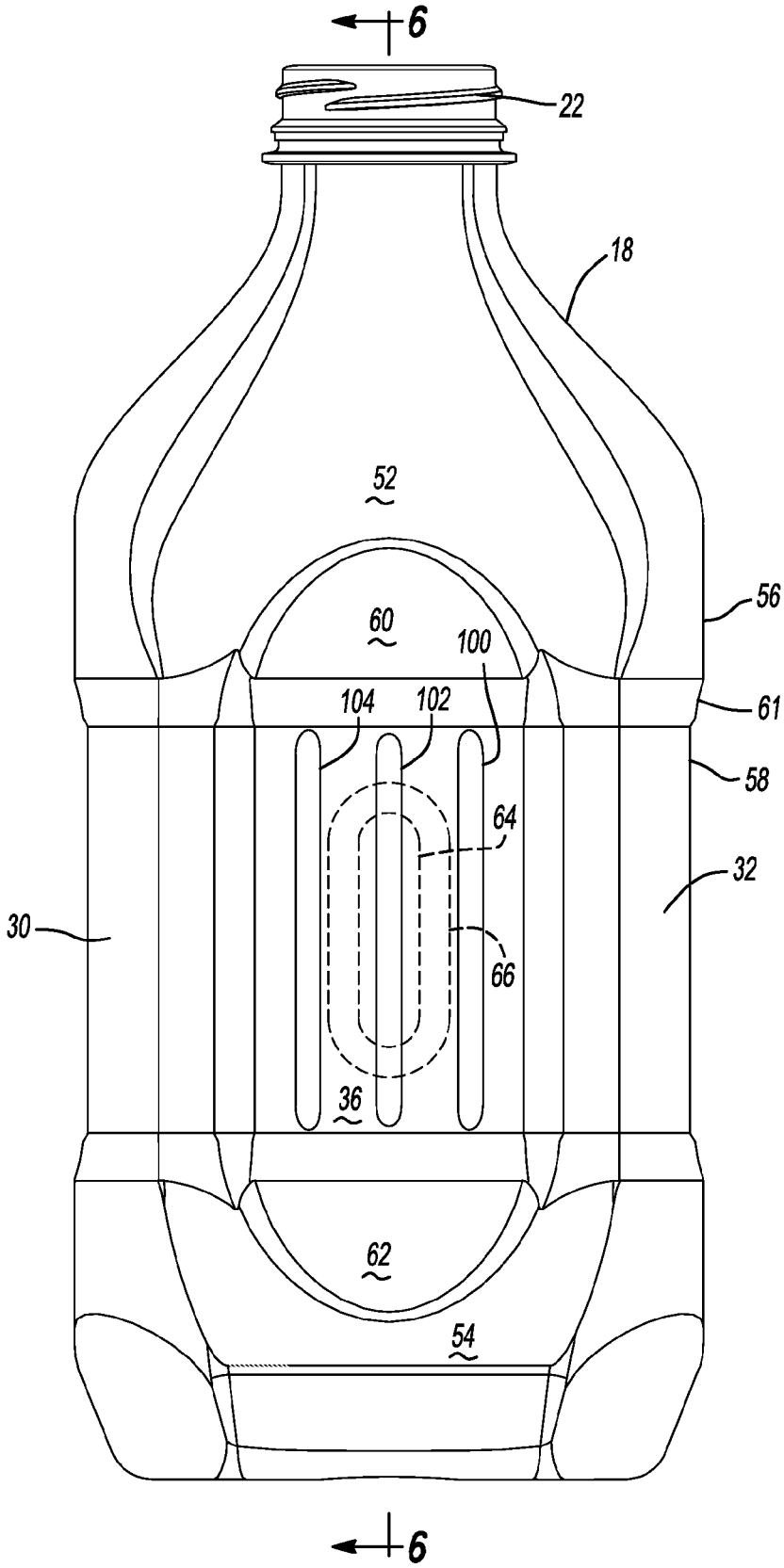
FIG. 2 is a side view of a broad side of the container depicting a sidewall with a vacuum panel and columns.
Figure 3:
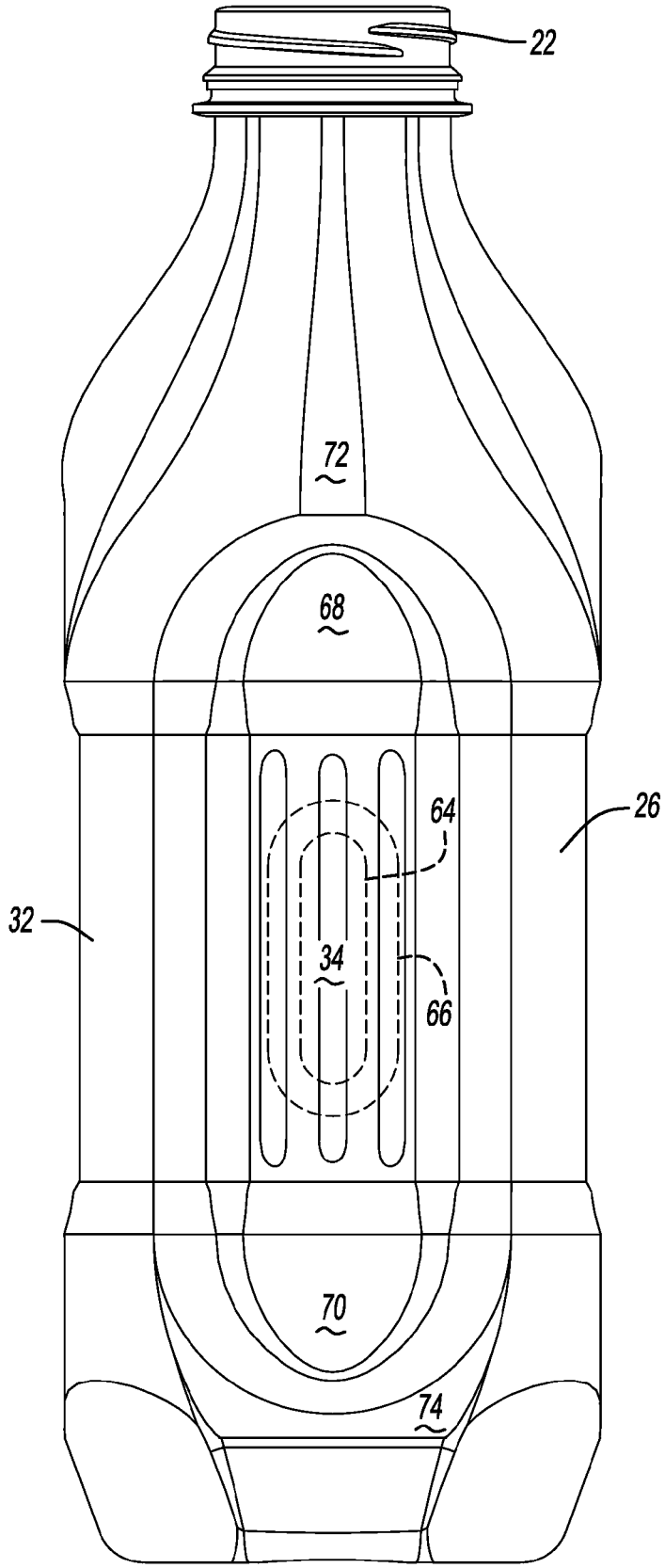
FIG. 3 is a side view of a narrow side of the container depicting a sidewall with a vacuum panel and columns.
Figure 5:
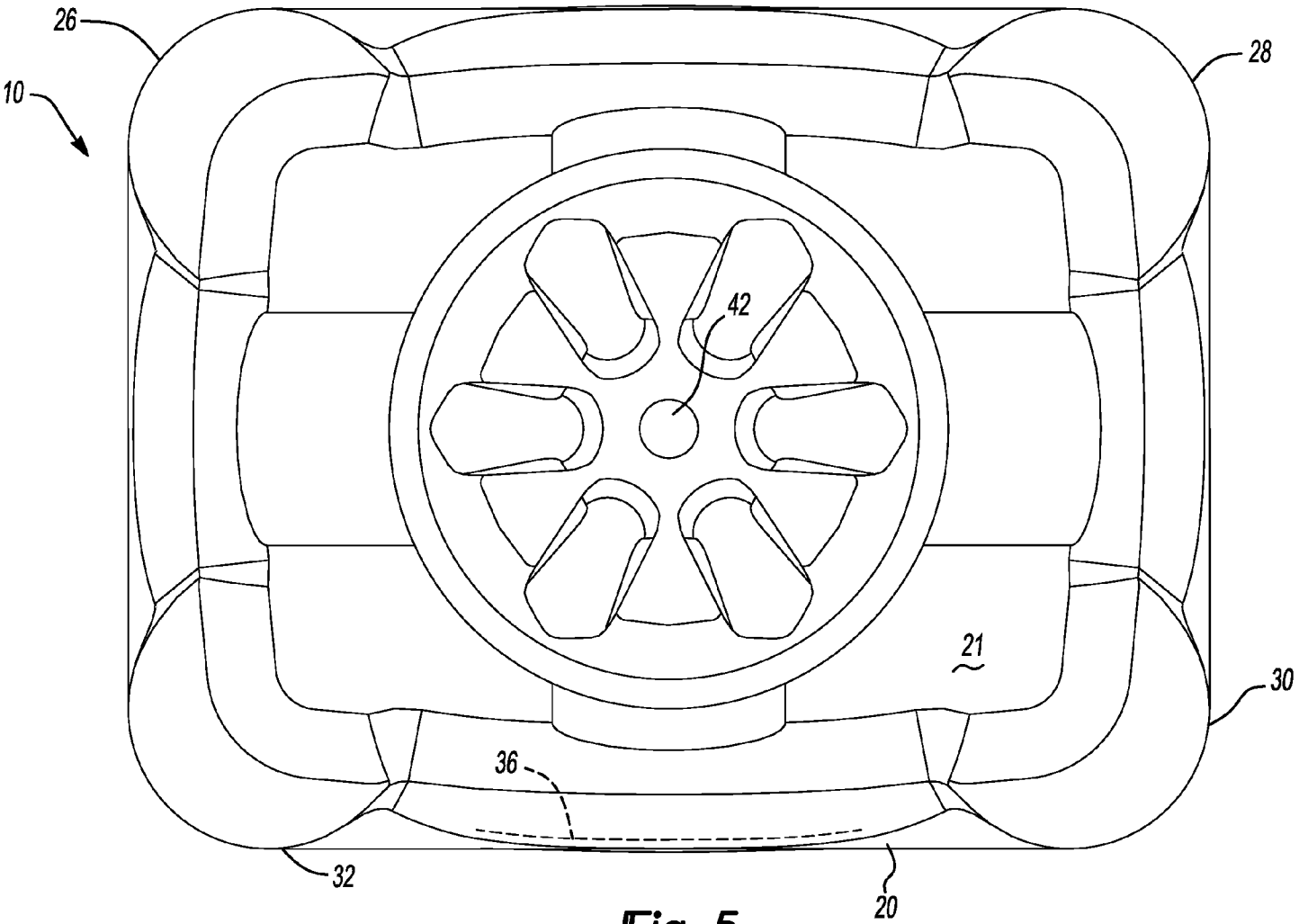
FIG. 5 is a bottom view of the container depicting columns at each of the corners of the container.

As depicted best in FIGS. 1-3, the container 10 generally includes a neck 14, which defines a mouth 16, a shoulder portion 18 and a bottom portion 20 forming a base 21 (FIG. 5). As depicted, the shoulder portion 18 and the bottom portion 20 may be substantially rectangular in cross-section. The cap 12 engages threads 22 on the neck 14 to close and seal the mouth 16.

Extending between the shoulder portion 18 and the bottom portion 20 is a sidewall or body 24 of the container 10. As best depicted in FIGS. 1, 4-5, and 7-8, the sidewall 24 may be approximately, substantially rectangular in cross-section to facilitate gripping by various sizes of human hands. More specifically, near the transition between the shoulder portion 18 and the sidewall 24, the cross-sectional shape may be relatively rectangular; however, as the shoulder portion 18 approaches the neck 14, the rectangular cross-sectional area decreases and transforms into a circular cross-section, which defines the neck 14. Within and throughout the sidewall 24, between the shoulder portion 18 and the bottom portion 20, the cross-sectional shape is relatively consistent, as depicted in FIGS. 1-3, for example. While the container 10 depicted is generally rectangular, other polygonal shapes, such as square, hexigon, multi-sided, and circular, are similarly contemplated.

Continuing, between the shoulder portion 18 and the bottom portion 20, the sidewall 24 employs vacuum panels 34, 36, 38, 40 between columns 26, 28, 30, 32. More specifically, vacuum panel 34 exists between column 26 and column 32, vacuum panel 36 exists between column 32 and column 30, vacuum panel 38 exists between column 30 and column 28, and vacuum panel 40 exists between column 28 and column 26. As depicted, for example in FIG. 8, vacuum panels 34, 36, 38, 40 are recessed or set-back toward a central vertical axis 42 of the container 10 as compared to the positioning of columns 26, 28, 30, 32, which jut-out or protrude outwardly and away from the central vertical axis 42 and vacuum panels 34, 36, 38, 40. Vacuum panels 34, 36, 38, 40 move in response to the creation of an internal vacuum pressure created during the cooling of a hot-fill product within the capped and sealed container 10. Vacuum panels 34, 36, 38, 40 may be convex to provide strength to the sidewall 24. With continued reference to FIG. 8, vacuum panel 34 and vacuum panel 38 depict movement in response to hot-fill product cooling. For instance, with respect to vacuum panel 38, the panel can be seen to move from molded position 44 to contraction position 46. In another example, the movement of the container 10 is relatively large compared to vacuum panel 38. For instance, vacuum panel 40 as molded may assume the molded position 48, while after hot-filling and capping the container 10, may assume the contraction position 50.

Figure 8:
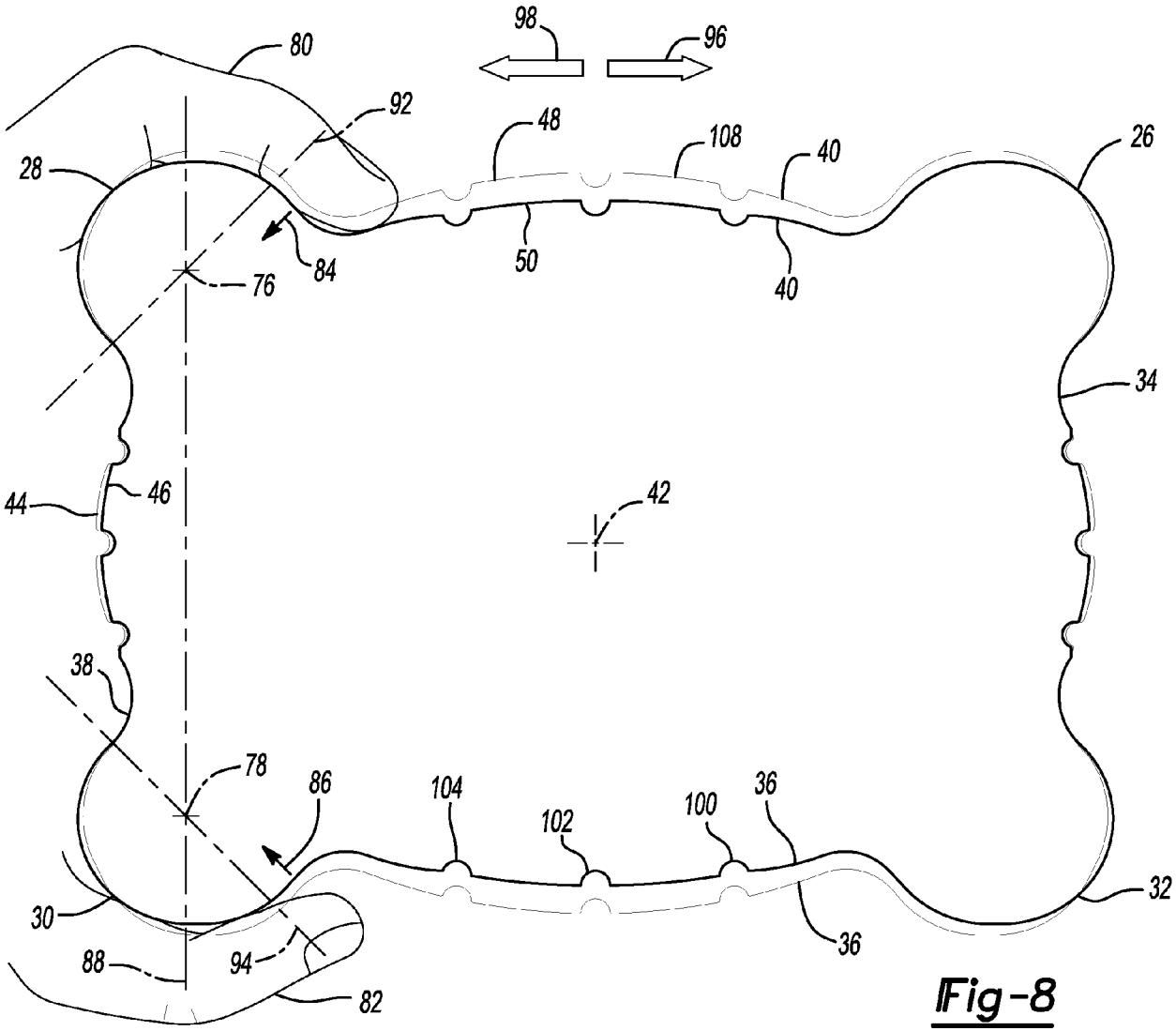
FIG. 8 is a cross-sectional line view of the container depicting movement of the vacuum panels before and after a vacuum is present within the container.

With continued reference to the to-scale depiction of FIG. 8, the vacuum panel 40 and its opposing counterpart, vacuum panel 36, undergo more movement than vacuum panels 34, 38, which also oppose each other. The reason for the larger movement of vacuum panels 36, 40 is due to the distance between the columns that support vacuum panels 36, 40. More specifically, column 26 and column 28, which support vacuum panel 40, and column 30 and column 32, which support vacuum panel 36, are located farther apart from one another than column 28 and column 30, which support vacuum panel 38, and column 26 and column 32, which support vacuum panel 34. The ability of a vacuum panel to resist bending and flexure due to the internal vacuum pressure of the cooling hot-fill liquid within the container 10 is related to the distance that vacuum panels 34, 36, 38, 40 span between columns 26, 28, 30, 32, with all other parameters being equal, such as panel thickness and panel geometry. Columns 26, 28, 30, 32 provide vertical strength and resistance to longitudinal flexure or bending as well as hoop strength to resist internal pressure. Columns 26, 28, 30, 32 exist at what would otherwise be the extended intersection of vacuum panels 34, 36, 38, 40 or at the corners of the container 10.

The container 10 is equipped with two larger vacuum panels 36, 40 and two smaller vacuum panels 34, 38, supported by columns on either side of the vacuum panels, as explained above. However, the container 10 possesses additional structural features to centralize or concentrate the deformation of the container 10 at vacuum panels 34, 36, 38, 40. FIG. 2 depicts the larger vacuum panel 36 positioned within the perimeter or confines of semi-circular or approximately semi-circular arches that afford vacuum panel 36 with additional strength and aid in concentrating vacuum panel 36 deformation. With respect to vacuum panel 36, an upper arch 52 is a transitional structure between vacuum panel 36 and shoulder portion 18. FIG. 2 depicts how an exterior surface 56 of the upper arch 52 is slightly raised, or protrudes outward slightly more than an exterior surface 58 of columns 30, 32. The juncture between the exterior surface 56 and the exterior surface 58 is blended or connected at an intermediary surface 61 that is angled, at an angle other than a right angle, relative to the central vertical axis 42. Because the exterior surface 56 of the container 10 has a larger overall circumference than the overall container circumference around the columns, the resistance to vacuum pressure and thus deformation is greater.

Regarding container deformation, and with continued reference to FIG. 2, because the columns 30, 32, the upper arch 52 and the lower arch 54 surround and isolate the vacuum panel 36, deformation is primarily limited to the vacuum panel 36, which includes an upper arch panel 60 and a lower arch panel 62. The deformation of the entire vacuum panel 36 generally follows an oblong or oval pattern with respect to degree of deformation. That is, deformation is greatest in the interior area bounded by an oval 64. Deformation would then be somewhat less within the area bounded by oval 66, and decrease in successive oval areas outward toward columns 30, 32 and arch panels 60, 62. However, some deformation does occur in columns 30, 32 as depicted in the cross-sectional view through the sidewall 24, including the vacuum panel 36, of FIG. 8. The arch panels above the vacuum panels 34, 36, 38, 40, for example arch panels 60, 68, and the arch panels below the vacuum panels 34, 36, 38, 40, for example arch panels 62, 70 may be convex to provide strength to the arch panels and control deformation of the arch panels. While the arch panels may act as a vacuum panel, they do not possess vacuum initiators and therefore, may not deflect as much as the vacuum panels 34, 36, 38, 40.

Because the container 10 depicted in FIGS. 1-8 may be rectangular, the container 10 has two opposing vacuum panels 34, 38 that are smaller in surface area than opposing vacuum panels 36, 40. As a representative example of one of the smaller vacuum panels, FIG. 3 depicts the vacuum panel 34 located between columns 26, 32. Similar to vacuum panel 36, the vacuum panel 34 has an area of deformation bounded by ovals 64, 66 within which deformation takes place when the internal volume of the container 10 is placed under a vacuum. More specifically, oval 64 will undergo a larger deformation than oval 66 because oval 64 is farther from either of columns 26, 32. Similar to the upper and lower arch panels 60, 62 above and below vacuum panel 36 of FIG. 2, above vacuum panel 34 of FIG. 3 is an upper arched panel 68 and a lower arched panel 70. The arched panels 68, 70 may undergo deformation depending upon the degree of vacuum pressure within the container 10 upon hot-product cooling. Regardless of the amount of deformation that the vacuum panel 34 and the arched panels 68, 70 may undergo, there is also an upper arch 72 and a lower arch 74 to prevent deformation from being experienced outside of the vacuum panel 34 and the arched panels 68, 70.

Another important feature of containers is their ability to be easily handled with a secure grip by a human hand. The container 10 of the present teachings is designed to be easily and securely gripped by a variety of hand sizes even if the container 10 contains 64 fluid ounces (1893 ml) or more of a liquid product. With reference to FIGS. 1-3, the positioning of columns 26, 28, 30, 32 provides a semi-circular structure (approximately 180 degrees) with the same radius with which to grip the container 10. With vacuum panels 34, 36, 38, 40 being recessed or located more closely to the central vertical axis 42 of the container 10 than the central axis of the columns, such as central column axis 76 of column 28 and central column axis 78 of column 30 (see FIG. 8), columns 26, 28, 30, 32 become easy and more secure to grip. Stated slightly differently, with columns 26, 28, 30, 32 protruding radially farther from the central vertical axis 42 of the container 10 than vacuum panels 34, 36, 38, 40, they provide a secure grip to a human hand. FIG. 8 depicts a secure grip by an index finger 80 around the column 28 and a thumb 82 around the column 30. In one example, the grip is deemed to be secure because a gripping force 84 of the index finger 80 and a gripping force 86 of the thumb 82 is coincident with an axis 88 that defines the straight line distance between the central column axis 76 and the central column axis 78. However, the structure of FIG. 8 permits the gripping force 84 to be applied to the column 28 and the gripping force 86 to be applied to the column 30 such that the gripping forces 84, 86 are beyond or past the axis 88 that defines the straight line distance between the central column axes 76, 78 to place the gripping force 84 between the central column axis 76 and the central vertical axis 42, and the gripping force 86 between the central column axis 78 and the central vertical axis 42. This combination of the placement of columns 28, 30 and the application of gripping forces 84, 86 relative to the central vertical axis 42, results in a very secure grip. If the gripping force is not applied past the axis 88, or rather, between the axis 88 and the central vertical axis 42, as viewed in FIG. 8, the grip will not be secure. Another reason that the grip immediately described is so secure is that if the force of gravity has a component in direction 96, each of the finger gripping forces 84, 86 provide a component in the opposite direction, direction 98, that permits the fingers to contact a respective column 28, 30. Appendages 80, 82 each contact a respective column 28, 30 although FIG. 8 does not particularly show such contact to preserve the integrity of the entire container 10 profile. Appendages 80, 82 wrap around columns 28, 30 during gripping.

Another gripping configuration that is similar to the above configuration is one in which the index finger 80 may be gripped around column 26 and the thumb 82 may be gripped around column 28. Such a grip may be better suited to a larger hand although the reasoning presented above in conjunction with FIG. 8 would also apply to such a grip.

Figure 4:
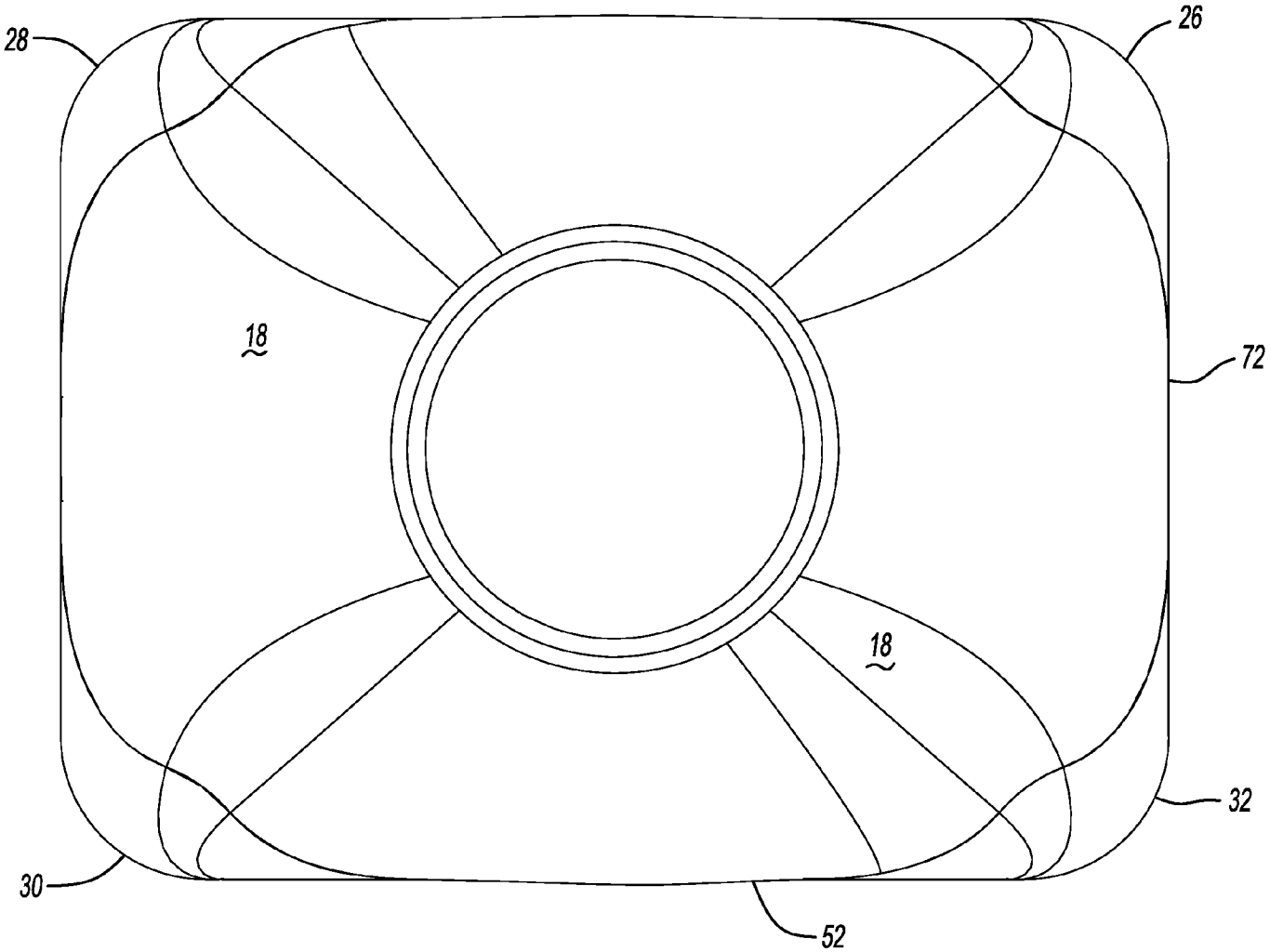
FIG. 4 is a top view of the container depicting a generally rectangular container shape.
Figure 6:
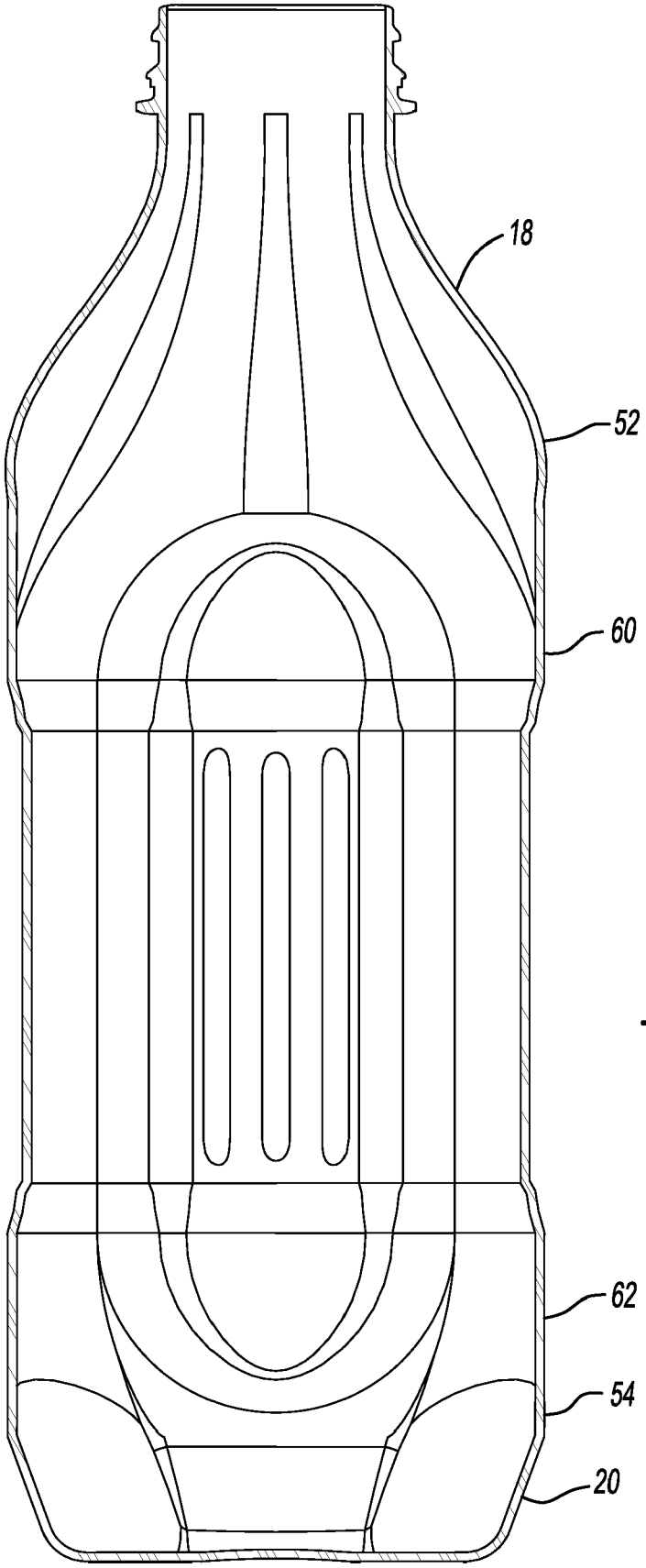
FIG. 6 is longitudinal cross-sectional view of the container depicting the vacuum panels of the container.

Turning to FIG. 4, a top view of the container 10 depicts how the upper arches 52, 72, blend into the shoulder portion 18 to create a smooth transition with no sharp or abrupt angles thereby creating a vessel whose internal vacuum draws evenly on the entire internal wall surface area. The upper arches 52, 72 are referred to as horizontal arches because they are largely horizontal when the container is standing with its bottom surface upon a flat support surface. Vacuum panels 34, 36, 38, 40 are recessed or located closer to the central vertical axis 42 than the juncture of the upper arches 52, 72 to the shoulder portion 18 or the juncture of columns 26, 28, 30, 32 to the shoulder portion 18. FIG. 6, which is a longitudinal cross-sectional view of the container 10, also depicts how the shoulder portion 18 blends into the upper arch 52 and the upper arch panel 60, and how the lower arch panel 62 blends into the lower arch 54 and the bottom portion 20.

Although columns 26, 28, 30, 32 provide structural rigidity to the container 10 by resisting deformation upon creation of a vacuum pressure within the container upon hot-product cooling, columns 26, 28, 30, 32 also provide longitudinal strength to the container 10 during top loading of the container 10, which occurs when a load or force is applied to the container 10 coincident with or parallel to its central vertical axis 42. More specifically, secondary packaging and shipping may cause added longitudinal forces and stress on the container 10. Containers may be packed in cardboard boxes and/or wrapped in plastic, such as shrink wrap, and stacked onto a pallet, which causes the lower layers of containers to undergo increased force and stress. The ability of the container 10 to support a vertical load is improved with columns 26, 28, 30, 32 positioned at each of the four corners of the container 10. Thus when cases, such as a case of six, twelve or twenty-four of the container 10 are hot-filled and capped, they may better support the forces and stresses caused by stacking arrangements, such as associated with stacking on a pallet.

Turning now to FIG. 5, which depicts a bottom view of the container 10, one can see how columns 26, 28, 30, 32 are positioned at the corners of the container 10. FIG. 5 also depicts how columns 26, 28, 30, 32 protrude farther from the central vertical axis 42 than the location of the vacuum panel 36. All vacuum panels 34, 36, 38, 40 have a similar relationship with its respective columns 26, 28, 30, 32, in that for a particular vacuum panel 34, 36, 38, 40, the columns immediately beside such vacuum panel will protrude farther from the central vertical axis 42 than the vacuum panel.

Figure 7:
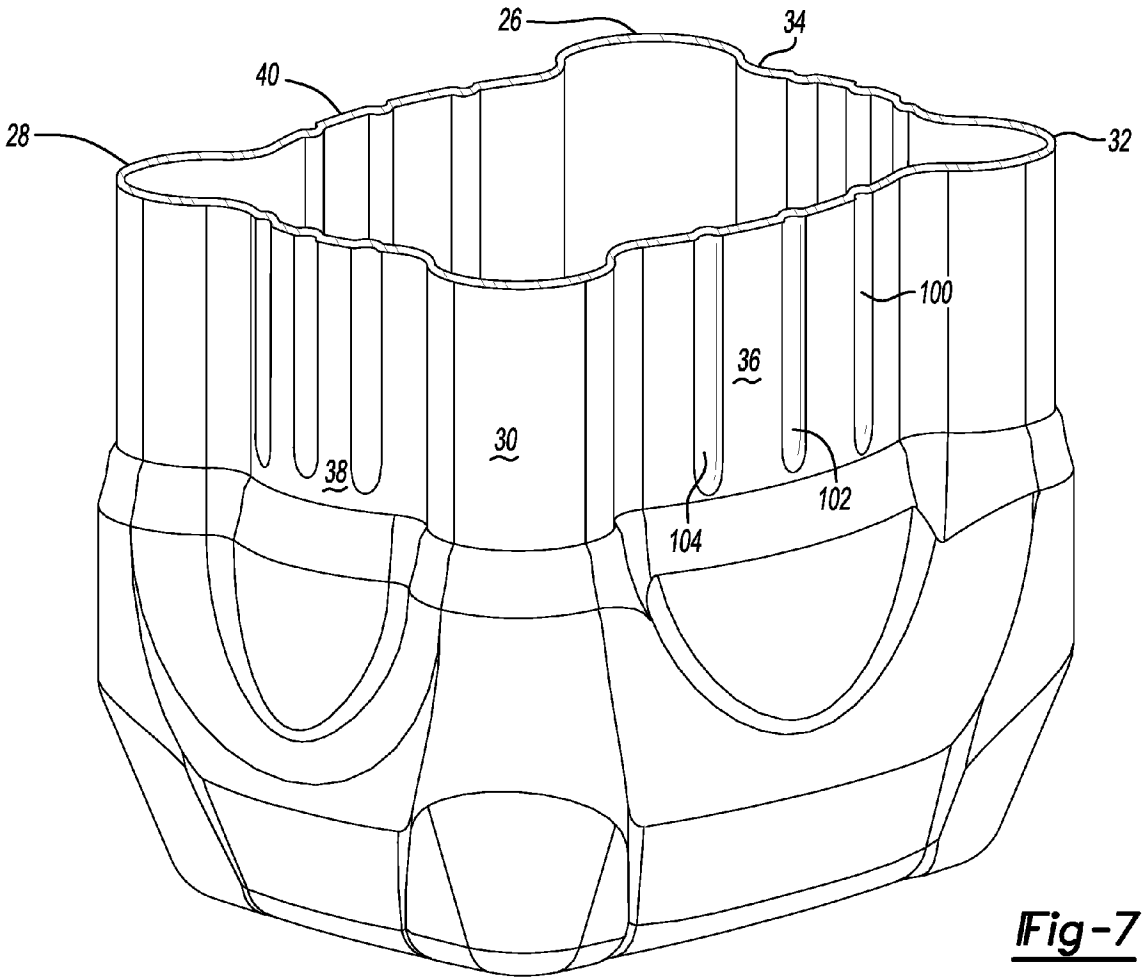
FIG. 7 is a perspective cross-sectional view of the container depicting the vacuum panels and vacuum initiators in the vacuum panels.

FIGS. 2, 7 and 8 depict another feature and advantage of the container 10. The container 10 primarily has four vacuum panels 34, 36, 38, 40 whose movement is initiated and assisted with the use of vacuum initiators. An explanation will be provided using vacuum panel 36, which employs vacuum initiators 100, 102 and 104. More specifically, vacuum initiator 102 experiences the first and most movement of vacuum panel 36 initiators because it lies at the center, or equidistant between columns 30, 32. As depicted with oval 64, this is also the area that undergoes the most movement during the creation of a vacuum within the volume of the container 10. The vacuum panel 36 is also equipped with vacuum initiators 100, 104 on either side of vacuum initiator 102. Vacuum initiators 100, 104 also respond to an internal vacuum within the container 10, but do not move toward the vacuum volume (toward the central vertical axis 42) as much as vacuum initiator 102 because vacuum initiator 100 is closer to the column 32 than vacuum initiator 102, and vacuum initiator 104 is closer to the column 30 than vacuum initiator 102. Thus, because columns 30, 32 are structural components and designed to not move, or move very little, relative to the vacuum panel 36 in response to an internal vacuum, the closer the vacuum panel material is to columns 30, 32, the less movement there will be in the vacuum panel 36.

There is another advantage of the hot-fill container 10 regarding columns 26, 28, 30, 32. Because columns 26, 28, 30, 32 are designed not to move or move very little, columns 26, 28, 30, 32 permit the container 10 to maintain its aesthetically pleasing appearance. As such, columns 26, 28, 30, 32 always act as a firm, non-deformable and secure gripping location for a human hand, as described above, regardless of whether an internal vacuum is present within the container 10.

The container 10 exhibits a further advantage. Hot-fill containers are known to be entirely cylindrical, which may be different from the teachings of the present container 10. With elongate cylindrical containers, the entire sidewall may be susceptible to contraction upon cooling of a hot-fill liquid and then expansion to restore the container's original sidewall position. Such contraction and expansion causes loosening of any label on the sidewall, even if the label is glued to the sidewall. Wrinkling of the label may also occur. The container 10 solves this problem by lessening the contraction of certain panels and for other panels, spreading the contraction out over a large area thus making the panel of movement nearly flat. For instance, FIG. 8 depicts the vacuum panels 34, 38 which move very little as evidenced by the molded position 44, which indicates positioning before a vacuum is applied, and the contraction position 46, which indicates positioning after a vacuum is applied. Such panel movement will not effect an attached label, which is an advantage of the structure. Similarly, vacuum panel 40 exhibits a before contraction vacuum panel molded position 48 and an after contraction vacuum panel contraction position 50. The placement of a label on the vacuum panel 40 of the container 10 will, like the vacuum panel 38, minimize or eliminate any label distortion during vacuum panel 40 contraction between vacuum panel molded position 48 and vacuum panel contraction position 50. The vacuum panel 40 is equipped with vacuum initiators 100, 102 and 104, and a land 108, so that any paper or plastic product label that may be glued to the land 108 of the vacuum panel 40 may recede into the vacuum initiators 100, 102 and 104 during contraction of the vacuum panel 40 permitting the label portion glued to the land 108 to remain glued to the land 108.

What is claimed is:

1. A container comprising:

a neck portion defining a mouth;

a shoulder portion formed with the neck portion and extending downward from the neck portion;

a bottom portion forming a base; and a container sidewall with a polygonal cross-section, the sidewall extending between and joining the shoulder portion and the bottom portion, the sidewall further comprising:

a first pair of opposing vacuum panels as part of the sidewall;

a first pair of opposing first upper arch panels above the first pair of opposing vacuum panels, each of the first upper arch panels arching away from the respective vacuum panel upward toward an upper apex and arching from the upper apex back downward toward the respective vacuum panel;

and a first pair of opposing lower arch panels below the first pair of opposing vacuum panels, each of the lower arch panels arching away from the respective vacuum panel downward toward a lower apex and arching from the lower apex back upward toward the respective vacuum panel.

2. The container of claim 1, further comprising:

a first pair of opposing upper arches above the first pair of opposing upper arch panels, the first pair of opposing upper arches transitioning between the first pair of opposing upper arch panels and the shoulder portion.

3. The container of claim 2, further comprising:

a first plurality of vacuum initiator grooves in the first pair of opposing vacuum panels.

4. The container of claim 3, further comprising:

a second pair of opposing vacuum panels as part of the sidewall, the second pair of opposing vacuum panels having a second plurality of vacuum initiator grooves, wherein the first pair of opposing vacuum panels is larger than the second pair of opposing vacuum panels.

5. The container of 4, further comprising:

a semicircular column located at each corner of the container, at intersection points of the first pair of opposing vacuum panels and the second pair of opposing vacuum panels as part of the sidewall.

6. The container of claim 5, wherein the columns protrude farther from a central vertical axis of the container than the first pair of opposing vacuum panels.

7. The container of claim 6, wherein the columns protrude farther from the central vertical axis of the container than the second pair of opposing vacuum panels.

8. The container of claim 7, further comprising:

a second pair of opposing upper arches above a second pair of opposing upper arch panels, the second pair of opposing upper arch panels located above the second pair of opposing vacuum panels, the second pair of opposing upper arches transitioning between the second pair of opposing upper arch panels and the shoulder portion.

9. A container structure defining a central vertical axis, the container structure comprising:

a neck portion defining a mouth;

a shoulder portion formed with the neck portion and extending downward from the neck portion;

a bottom portion forming a base; and a container sidewall with a substantially rectangular cross-section, the sidewall extending between and joining the shoulder portion and the bottom portion, the sidewall further comprising:

a first pair of opposing outwardly convex vacuum panels as part of the sidewall;

a first pair of opposing upper outwardly convex arch panels above the first pair of opposing vacuum panels, each upper outwardly convex arch panel arching away from the respective vacuum panel upward toward an upper apex and arching from the upper apex back downward toward the respective vacuum panel;

a first pair of opposing lower outwardly convex arch panels below the first pair of opposing vacuum panels, each of the lower outwardly convex arch panels arching away from the respective vacuum panel downward toward a lower apex and arching from the lower apex back upward toward the respective vacuum panel; and a second pair of opposing outwardly convex vacuum panels as part of the sidewall, wherein the first pair of opposing vacuum panels is larger in surface area than the second pair of opposing vacuum panels.

10. The container structure of claim 9, further comprising:

a second pair of opposing upper outwardly convex arch panels above the second pair of opposing vacuum panels; and a second pair of opposing lower outwardly convex arch panels below the second pair of opposing vacuum panels.

11. The container structure of claim 10, further comprising:

a first pair of opposing upper outwardly convex arches above the first pair of opposing upper outwardly convex arch panels, the first pair of opposing upper outwardly convex arches transitioning between the first pair of opposing upper convex arch panels and the shoulder portion.

12. The container structure of claim 11, further comprising:

a second pair of opposing upper outwardly convex arches above the second pair of opposing upper outwardly convex arch panels, the second pair of opposing upper outwardly convex arches transitioning between the second pair of opposing upper outwardly convex arch panels and the shoulder portion.

13. The container structure of claim 12, wherein the first pair of opposing outwardly convex vacuum panels defines a first pair of opposing vacuum initiators and the second pair of opposing outwardly convex vacuum panels defines a second pair of opposing vacuum initiators.

14. The container structure of claim 13, further comprising:

a plurality of vertical columns, the vertical columns joining the first pair of opposing outwardly convex vacuum panels to the second pair of opposing outwardly convex vacuum panels.

15. The container structure of claim 14, wherein the plurality of vertical columns are directly molded into the first pair of opposing upper outwardly convex arches and the second pair of opposing upper outwardly convex arches.

16. A container structure defining a central vertical axis, the container structure comprising:

a neck portion defining a mouth;

a shoulder portion formed with the neck portion and extending downward from the neck portion;

a bottom portion forming a base;

a container sidewall with a substantially rectangular cross-section, the sidewall extending between and joining the shoulder portion and the bottom portion, the sidewall further comprising:

a first pair of opposing outwardly convex vacuum panels; and a second pair of opposing outwardly convex vacuum panels, wherein the first pair of opposing outwardly convex vacuum panels is larger in surface area than the second pair of opposing outwardly convex vacuum panels;

a plurality of vertical columns joining the first pair of opposing outwardly convex vacuum panels to the second pair of opposing outwardly convex vacuum panels;

a first pair of opposing upper outwardly convex arch panels above the first pair of opposing outwardly convex vacuum panels, each of the upper outwardly convex arch panels in the first pair arching away from the respective vacuum panel upward toward a first upper apex and arching from the first upper apex back downward toward the respective vacuum panel;

a second pair of opposing upper outwardly convex arch panels above the second pair of opposing outwardly convex vacuum panels, each of the upper outwardly convex arch panels in the second pair arching away from the respective vacuum panel upward toward a second upper apex and arching from the second upper apex back downward toward the respective vacuum panel;

a first pair of opposing upper outwardly convex arches above the first pair of opposing upper outwardly convex arch panels, the first pair of opposing upper outwardly convex arches located between and contacting the first pair of opposing upper outwardly convex arch panels and the shoulder portion;

a second pair of opposing upper outwardly convex arches above the second pair of opposing upper outwardly convex arch panels, the second pair of opposing upper outwardly convex arches located between and contacting the second pair of opposing upper outwardly convex arch panels and the shoulder portion, the plurality of vertical columns directly molded into the first pair of opposing upper outwardly convex arches and the second pair of opposing upper outwardly convex arches;

a first pair of opposing lower outwardly convex arch panels located below the first pair of opposing outwardly convex vacuum panels, each of the lower outwardly convex arch panels arching away from the respective vacuum panel downward toward a first lower apex and arching from the first lower apex toward the respective vacuum panel; and a second pair of opposing lower outwardly convex arch panels located below the second pair of opposing outwardly convex vacuum panels, each of the lower outwardly convex arch panels arching away from the respective vacuum panel downward toward a second lower apex and arching from the second lower apex toward the respective vacuum panel.

17. The container structure of claim 16, further comprising:

a first pair of opposing lower outwardly convex arches located below the first pair of opposing lower outwardly convex arch panels; and a second pair of opposing lower outwardly convex arches located below the second pair of opposing lower outwardly convex arch panels, wherein the first and second pair of opposing lower outwardly convex arches are directly molded to the bottom portion.

18. The container structure of claim 17, further comprising:

a first pair of opposing vacuum initiators molded into the first pair of opposing outwardly convex vacuum panels; and a second pair of opposing vacuum initiators molded into the second pair of opposing outwardly convex vacuum panels.

* * * * *

UNITED STATES PATENT AND TRADEMARK OFFICE

CERTIFICATE OF CORRECTION

PATENT NO. : 8,113,369 B2
APPLICATION NO. : 12/341372
DATED : February 14, 2012
INVENTOR(S) : Luke A. Mast et al.

It is certified that error appears in the above-identified patent and that said Letters Patent is hereby corrected as shown below:

Column 3, line 5, after "is" insert --a--.

Column 8, line 53, Claim 5, after "of" insert --claim--.

Signed and Sealed this
Tenth Day of April, 2012

David J. Kappos

David J. Kappos
*Director of the United States Patent and Trademark Office*